US005408277A

United States Patent [19]

Strijbos et al.

[11] Patent Number: 5,408,277

[45] Date of Patent: Apr. 18, 1995

[54] DISPLAY TUBE WITH DEFLECTION UNIT SECURED THEREON BY MEANS OF A SHRINK SLEEVE

[75] Inventors: Petrus A. W. Strijbos; Gerardus M. M. Van De Hei, both of Eindhoven; Petrus A. M. Fleuren, Nuenen, all of Netherlands

[73] Assignee: U.S. Philips Corporation, New York, N.Y.

[21] Appl. No.: 190,701

[22] Filed: Feb. 2, 1994

Related U.S. Application Data

[63] Continuation of Ser. No. 908,140, Jul. 2, 1992, abandoned.

[30] Foreign Application Priority Data

Jul. 2, 1991 [EP] European Pat. Off. ..... 91201689

[51] Int. Cl.[6] ..... H01J 29/74; H01J 9/44

[52] U.S. Cl. ..... 348/831; 445/23

[58] Field of Search ..... 445/23; 358/248; 156/86; 348/829, 830, 831

[56] References Cited

U.S. PATENT DOCUMENTS

| | | | |
|---|---|---|---|
| 4,186,414 | 1/1980 | Barinek | 358/248 |
| 4,338,584 | 7/1982 | Howard | 358/248 |
| 4,440,821 | 4/1984 | Komura et al. | 156/86 X |
| 4,993,149 | 2/1991 | Zilligen et al. | 156/86 X |

OTHER PUBLICATIONS

Database WPIL; Wk 9027; Derw. Publ., London AN 90207357 RD-A-314072 Anonymous 10 Jun. 1990 (Abstract only).

*Primary Examiner*—Kenneth J. Ramsey
*Attorney, Agent, or Firm*—Robert J. Kraus

[57] ABSTRACT

Display tube with a deflection unit which is mounted thereon and includes a funnel-shaped coil support. After the optimum position of the deflection unit has been set with respect to the display tube, the coil support is fixedly secured to the envelope of the display tube. A shrink sleeve which is partly shrunk around the narrow end of the coil support and partly around the envelope of the tube is used for fixation.

9 Claims, 1 Drawing Sheet

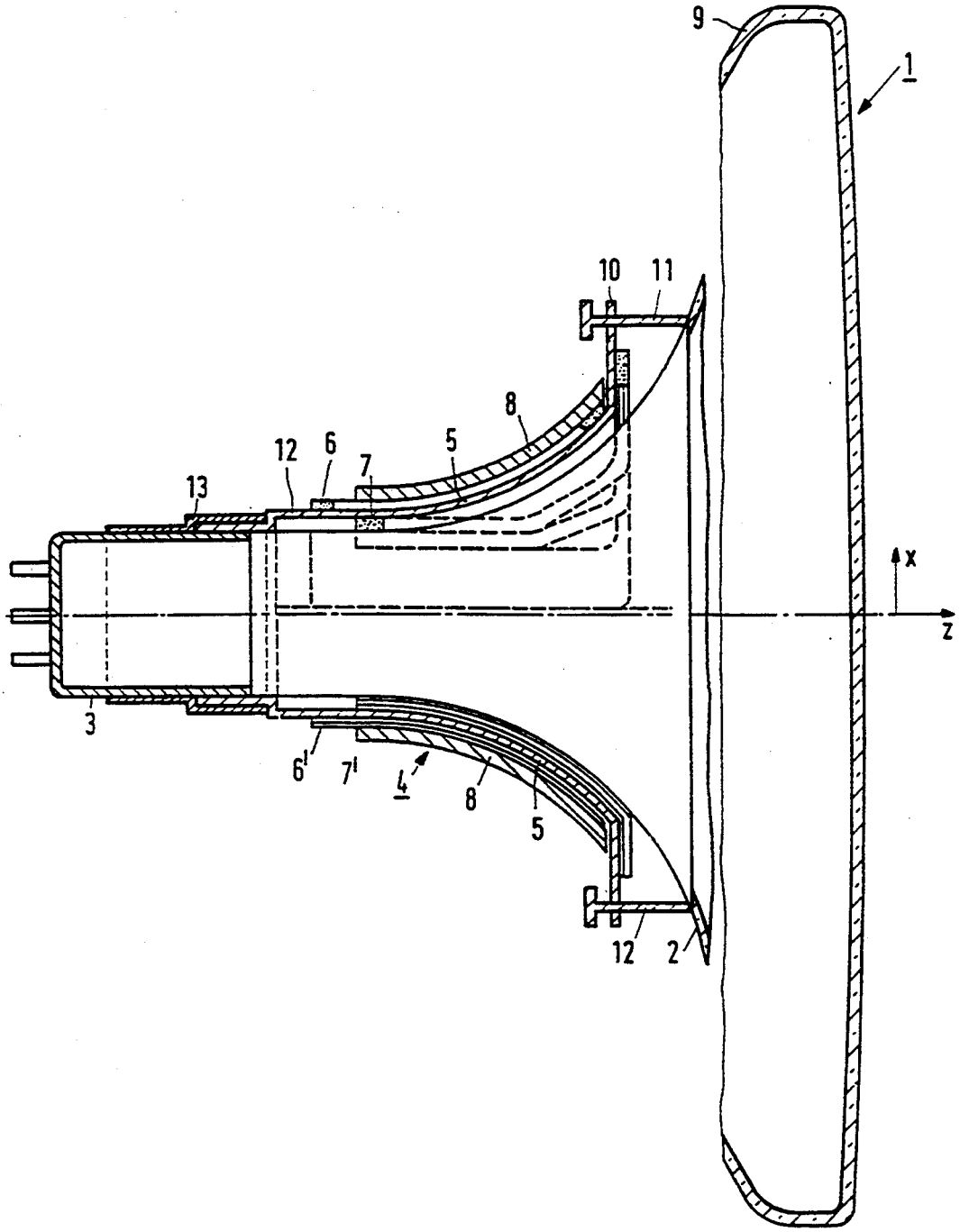
9
1
10
11
8
12
6
5
7
13
x
z
3
6'
7'
4
8
5
12
2

DISPLAY TUBE WITH DEFLECTION UNIT SECURED THEREON BY MEANS OF A SHRINK SLEEVE

This is a continuation of application Ser. No. 07/908,140, filed Jul. 2, 1992, now abandoned.

BACKGROUND OF THE INVENTION

1. Field of the Invention

The invention relates to a display tube with a deflection unit which is mounted on said tube and comprises a coil support, said deflection unit being fixedly secured to the envelope of the display tube in an operational position with respect to the display tube.

2. Description of the Related Art

It is known that in display tubes of the type used for TV receivers and monitors a deflection unit is slid on the neck of the display tube after its assembly, which deflection unit is supported by the funnel-shaped portion of the envelope of the display tube.

In practice, the rear end of the coil support of the deflection unit is fixedly secured to the glass neck of the display tube by means of a metal clamping strap. For a good performance it is generally necessary to set the correct operational position of each deflection unit with respect to its display tube in advance, notably by moving in the axial direction, by tilting, and/or by rotating about its longitudinal axis so as to optimally adjust given parameters such as colour purity, convergence and the position of the grid with respect to the display screen.

In this connection it is desirable to use easy-assembly techniques for fixing the deflection unit on the neck, i.e. techniques which require a small number of components, are preferably not time-consuming and can preferably be automated without this being at the expense of the mechanical specifications (such as resistance to drop tests).

SUMMARY OF THE INVENTION

It is an object of the invention to provide a display tube with a deflection unit in which an easy-assembly fixation of the deflection unit is inherent.

This object is achieved in that the deflection unit is secured to the envelope of the display tube, using an annular body of a synthetic material which shrinks when thermal energy is applied to it ("shrink sleeve"), one end of the annular body being shrunk around one end of the coil support and the other end of the annular body being shrank around the envelope of the display tube.

The use of an annular body (or sleeve) of a synthetic material which shrinks under the influence of applying thermal energy (known as shrink sleeve) for the purpose of fixing renders a clamping strap with a bolt and the associated time-consuming operation of tightening the bolt redundant. This tightening operation cannot be automated. Moreover, the use of a shrink sleeve leads to less neck breakage, while nevertheless mechanical requirements such as resistance to drop tests and satisfactory long-term fixation are satisfied. In this respect deflection units glued onto the neck or secured by means of rubber constructions are not satisfactory. However, it is possible to choose such a material for the shrink sleeve that when setting the correct final position of the deflection unit the shrink sleeve has sufficient flexibility so that it does not impede such setting. By applying thermal energy and subsequently cooling, the shrink sleeve shrinks tightly around the envelope of the display tube and the end of the coil support so that it retains the setting of the deflection unit.

The material of the annular body may be selected from a plurality of known synthetic materials which are suitable for forming objects which shrink when thermal energy is applied to them. Suitable materials are, inter alia, thermoplastic synthetic materials such as polyolefins, polyvinylidene fluoride, polythene, soft PVC.

The invention also relates to a method of manufacturing a display tube in which during one manufacturing step a deflection unit is arranged around the envelope of the display tube, the position of the deflection unit with respect to the display tube is accurately set and the deflection unit is fixed on the envelope of the display tube. This method is characterized in that prior to setting the deflection unit in its final position an annular body of a synthetic material which shrinks when thermal energy is applied to it is arranged on one end of the deflection unit and the adjacent part of the envelope of the display tube, and in that after (and possibly also during) setting the deflection unit position the annular body is heated so as to make it shrink.

BRIEF DESCRIPTION OF THE DRAWING

These and other aspects of the invention will be elucidated with reference to the embodiments described hereinafter with reference to the accompanying sole drawing, designated FIG. 1, showing.

A display tube with a deflection unit according to the invention.

DESCRIPTION OF THE PREFERRED EMBODIMENTS

The display tube 1 in FIG. 1 has a funnel-shaped portion (cone) 2 and a neck 3. A deflection unit 4 includes a coil support 5 of, for example, synthetic material, which supports a pair of field deflection coils 6, 6', a pair of line deflection coils 7, 7' and a yoke ring 8, and is arranged on the envelope 9 of the display tube so that the front end 10 of coil supports is supported by the funnel-shaped portion 2. Adjustable members such as bolts or pins 11, 12 may be used, for example, for supporting the front end in the correct position. Thus, after deflection unit 4 has been slid on the neck 3, it can be set to its optimum final position with respect to the display tube 1. When setting to the correct position, use can be made of a match head with grippers. To retain the optimum position once set, use is made of an annular body 13 of a material which shrinks when thermal energy is applied to it (commonly known as shrink sleeve) and one end of which is shrunk around the rear end 12 of the coil support 5 and the other end of which is shrunk around the neck 3. The shrink sleeve may be, for example, cylindrical having a constant diameter, or bottle-shaped with a wider end surrounding the coil support 5 and a narrower end surrounding the neck 3. The shrink sleeve 13 may have a thickness ranging between, for example several tenths of millimeters to one or several millimeters, a length of 1 to 5 cm, and a diameter of one to several centimeters.

The material of the shrink sleeve may be chosen from a plurality of known thermoplastic synthetic materials. When the shrink sleeve 13 is being formed, it is subjected to a stretching process in the heated state and is subsequently cooled to make it suitable for a process in which it reassumes its original shape when thermal energy is applied.

In its stretched shape the shrink sleeve 13 is arranged on the rear end of the coil support 5 and on the adjacent part of the neck 3. After the position of the deflection unit 4 is set optimally, thermal energy is applied to the shrink sleeve 13. (A practical form of supplying energy is the use of IR radiators or a hot-air gun.) The supply of thermal energy may already be started when the desired position is being set. By supplying thermal energy, the shrink sleeve attempts to reassume its original shape. The shrink sleeve then shrinks tightly around the coil support, and so the neck and the optimum position of the deflection unit 4 is fixed. The display tube with the deflection unit thereon can therefore be removed from the aligning apparatus a very short time after it has been aligned, the optimum setting being fixed fully automatically.

Fixation of the rear end 12 of the coil support 5 on the neck of the display tube by means of a shrink sleeve 13 has been described in the foregoing. Alternatively, the display screen-facing front end 10 of the coil support 5 can be fixed on the cone of the display tube by means of a shrink sleeve. Adjusting members, such as the adjusting members 11 and 12 may then be dispensed with. If necessary, the two ends of coil supports 5 may be fixed simultaneously in this manner.

A shrink sleeve is manufactured, for example, by crosslinking the material of an extruded flexible tube of a polymer material by means of $\beta$ radiation and by subsequently heating and stretching it. The sleeve is then cooled in its stretched state so that the stretched shape is maintained.

In this state the sleeve is sold to the "consumer". The material, which is still under tensile stress will attempt to reassume its original shape (i.e. the shape actually formed by means of a chemical reaction (crosslinking)) when it is has been reheated to a temperature above its softening point. The latter operation is carried out by the customer, in this case the manufacturer of the display tube, when the deflection unit is fixed in position on the tube.

Within the scope of the invention it may be practical to provide at least one end of the coil support with a shrink sleeve projecting beyond this end, before the coil support is placed on a display tube. The shrink sleeve may be secured in its non-shrink state to the coil support and shrunk onto this support (during or after setting the position of the coil support on the display tube), or it may be secured already in its shrunk state to the coil support.

It has proven to enhance the mechanical strength of the coil support connection if the sleeve, before it is placed on the coil support, is provided on its inner surface with an adhesive thin layer of a bonding material.

We claim:

1. A display apparatus comprising a cathode ray tube, a deflection unit, including a deflection coil support, mounted on said tube, and attachment means for securing the deflection unit on the tube in a selected operational position and orientation, said attachment means comprising a tubular member of a heat-shrinkable synthetic material and an adhesive bonding material disposed on an inner surface of said tubular member, a first end of said member being shrunk around an end of the coil support and a second end of said member being shrunk around a portion of the tube.

2. A display apparatus as in claim 1 where the heat-shrinkable synthetic material comprises a thermoplastic synthetic material selected from the group of polyolefin, polyvinylidene fluoride, polythene and soft PVC.

3. A method of mounting a deflection unit, including a deflection coil support, on a cathode ray tube, said method comprising the steps of:

a. placing the deflection unit on the tube;

b. attaching a tubular member of a heat-shrinkable synthetic material having an adhesive bonding material disposed on an inner surface thereof by disposing a first end of said tubular member around an end of the coil support and by disposing a second end of said member around a portion of the tube;

c. adjusting the deflection unit to a selected operational position and orientation relative to the tube;

d. heating the tubular member until respective portions of said member shrink around said end of the coil support and around said portion of the tube, thereby bonding the coil support to the tube.

4. A method as in claim 3 where the heat-shrinkable synthetic material comprises a thermoplastic synthetic material selected from the group of polyolefin, polyvinylidene fluoride, polythene and soft PVC.

5. A method as in claim 3 where the tubular member has a substantially cylindrical shape before the shrinking step is carried out.

6. A method as in claim 3 where, before the shrinking step is carried out, the tubular member has a bottle shape, the first end of said member having a different diameter than the second end of said member.

7. A method as in claim 3 where the first end of the tubular member is disposed around the end of the coil support before the deflection unit is placed on the tube.

8. A method as in claim 3 where the heating step is performed during the adjusting step.

9. A method as in claim 3 where the heating step is performed after the adjusting step.

* * * * *